US005331707A

United States Patent [19]

Irizarry

[11] Patent Number: 5,331,707

[45] Date of Patent: Jul. 26, 1994

[54] PRESSURE ALARM TOOTHBRUSH ASSEMBLY

[76] Inventor: Joseph Irizarry, HC 89 Box 51, Pocono Pines, Pa. 18350

[21] Appl. No.: 9,040

[22] Filed: Jan. 26, 1993

[51] Int. Cl.[5] ..... A46B 9/04

[52] U.S. Cl. ..... 15/167.1; 15/105; 128/776

[58] Field of Search ..... 15/167.1, 22.1, 22.4, 15/105, 143.1, 145; 73/862.621, 862.625, 862.636; 434/263; 128/776, 777; 116/212

[56] References Cited

U.S. PATENT DOCUMENTS

| | | | |
|---|---|---|---|
| 4,253,212 | 3/1981 | Fujita | 15/167.1 |
| 4,450,599 | 5/1984 | Scheller et al. | 15/22.1 |
| 4,476,604 | 10/1984 | White et al. | 15/167.1 |
| 4,680,825 | 7/1987 | White et al. | 15/167.1 |
| 4,698,869 | 10/1987 | Mierau et al. | 15/167.1 |
| 4,744,124 | 5/1988 | Wang et al. | 15/105 |
| 4,791,940 | 12/1988 | Hirschfeld et al. | 128/777 |

FOREIGN PATENT DOCUMENTS

| | | | |
|---|---|---|---|
| 269906 | 9/1992 | Japan | 15/167.1 |
| 609238 | 2/1979 | Switzerland | 15/22.1 |
| 10979 | 7/1992 | World Int. Prop. O. | 15/22.1 |

*Primary Examiner*—Timothy F. Simone
*Assistant Examiner*—Tony G. Soohoo
*Attorney, Agent, or Firm*—E. Michael Combs

[57] ABSTRACT

A toothbrush is arranged for reception within a housing, with the toothbrush arranged to be positioned between spring contacts within the housing, whereupon deflection of the toothbrush shaft relative to the contacts effects electrical communication upon excessive pressure being applied to the toothbrush shaft to actuate an audible alarm to indicate excessive pressure employed during a toothbrushing procedure.

4 Claims, 4 Drawing Sheets

12
10
15
11
14
13
3
17
21
20
16
2
2
3

19
18

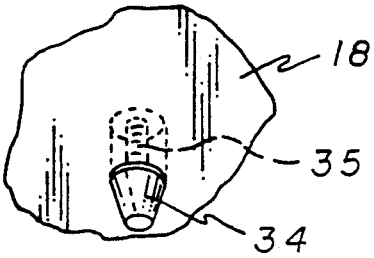
FIG 7
FIG 8
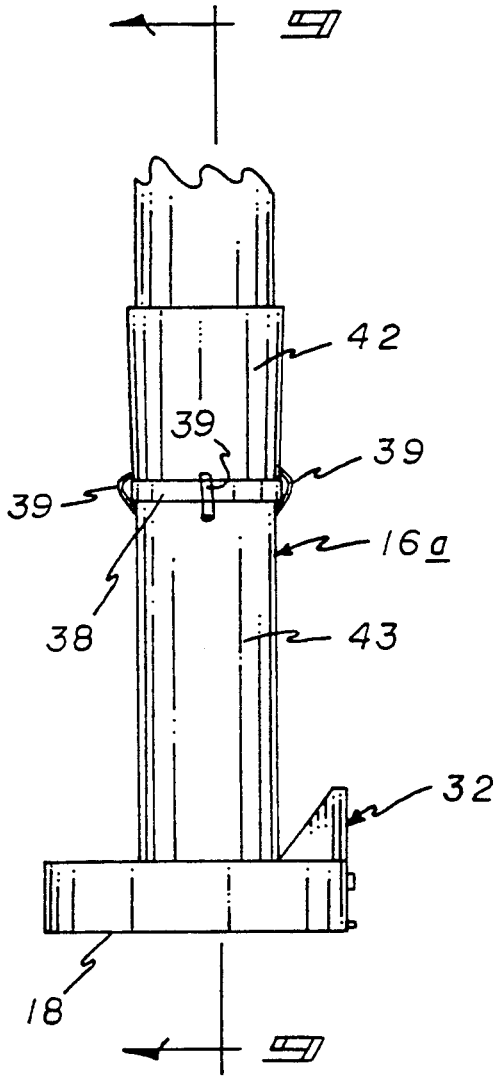
FIG 9
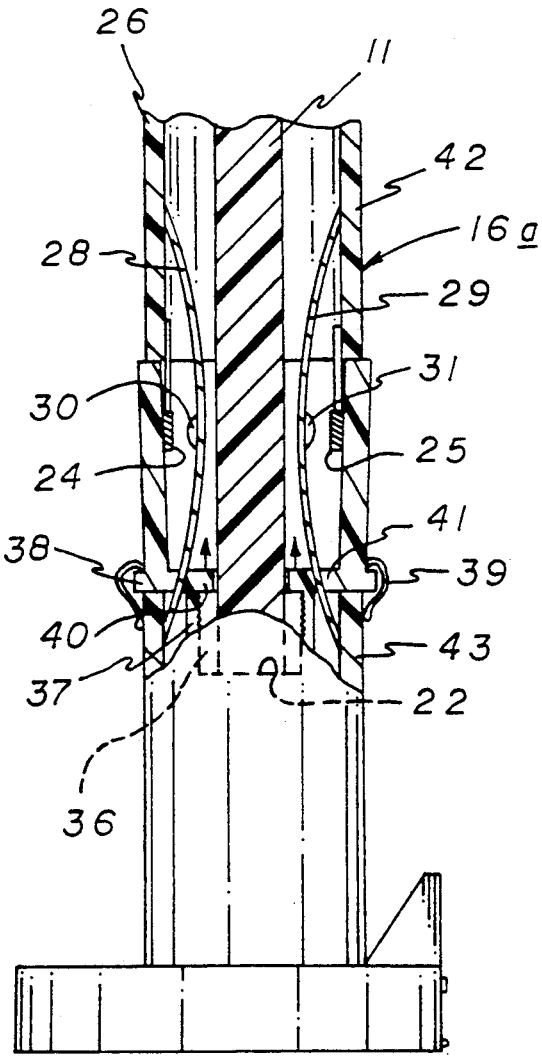

PRESSURE ALARM TOOTHBRUSH ASSEMBLY

BACKGROUND OF THE INVENTION

1. Field of the Invention

The field of invention relates to toothbrush apparatus, and more particularly pertains to a new and improved pressure alarm toothbrush assembly wherein the same is directed to the indication of excessive pressure employed in a toothbrushing procedure.

2. Description of the Prior Art

Toothbrush apparatus of various types are utilized throughout the prior art and exemplified by U.S. Pat. No. 4,450,599 to Scheller indicating contacts arranged within a housing to indicate excessive pressure exerted during a toothbrushing.

The instant invention attempts to overcome deficiencies of the prior art by providing for a structure arranged to provide for the indication of toothbrushing excessive pressure, as well as permitting adjustment of the pressure to actuate an associated audible alarm and in this respect, the present invention substantially fulfills this need.

SUMMARY OF THE INVENTION

In view of the foregoing disadvantages inherent in the known types of toothbrush apparatus now present in the prior art, the present invention provides a pressure alarm toothbrush assembly wherein the same is arranged to indicate excessive pressure effected by deflection of a toothbrush shaft relative to a receiving housing. As such, the general purpose of the present invention, which will be described subsequently in greater detail, is to provide a new and improved pressure alarm toothbrush assembly which has all the advantages of the prior art toothbrush apparatus and none of the disadvantages.

To attain this, the present invention provides a toothbrush arranged for reception within a housing, with the toothbrush arranged to be positioned between spring contacts within the housing, whereupon deflection of the toothbrush shaft relative to the contacts effects electrical communication upon excessive pressure being applied to the toothbrush shaft to actuate an audible alarm to indicate excessive pressure employed during a toothbrushing procedure.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention, It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved pressure alarm toothbrush assembly which has all the advantages of the prior art toothbrush apparatus and none of the disadvantages.

It is another object of the present invention to provide a new and improved pressure alarm toothbrush assembly which may be easily and efficiently manufactured and marketed.

It is a further object of the present invention to provide a new and improved pressure alarm toothbrush assembly which is of a durable and reliable construction.

An even further object of the present invention is to provide a new and improved pressure alarm toothbrush assembly which is susceptible of a low cost of manufacture with regard to both materials and labor, and which accordingly is then susceptible of low prices of sale to the consuming public, thereby making such pressure alarm toothbrush assemblies economically available to the buying public.

Still yet another object of the present invention is to provide a new and improved pressure alarm toothbrush assembly which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 7 is an enlarged orthographic view of section 7 as set forth in FIG. 6.

FIG. 8 is a partial orthographic view of a modified housing structure employed by the invention.

FIG. 9 is an orthographic view, taken along the lines 9—9 of FIG. 8 in the direction indicated by the arrows.

DESCRIPTION OF THE PREFERRED EMBODIMENT

Figure 1:
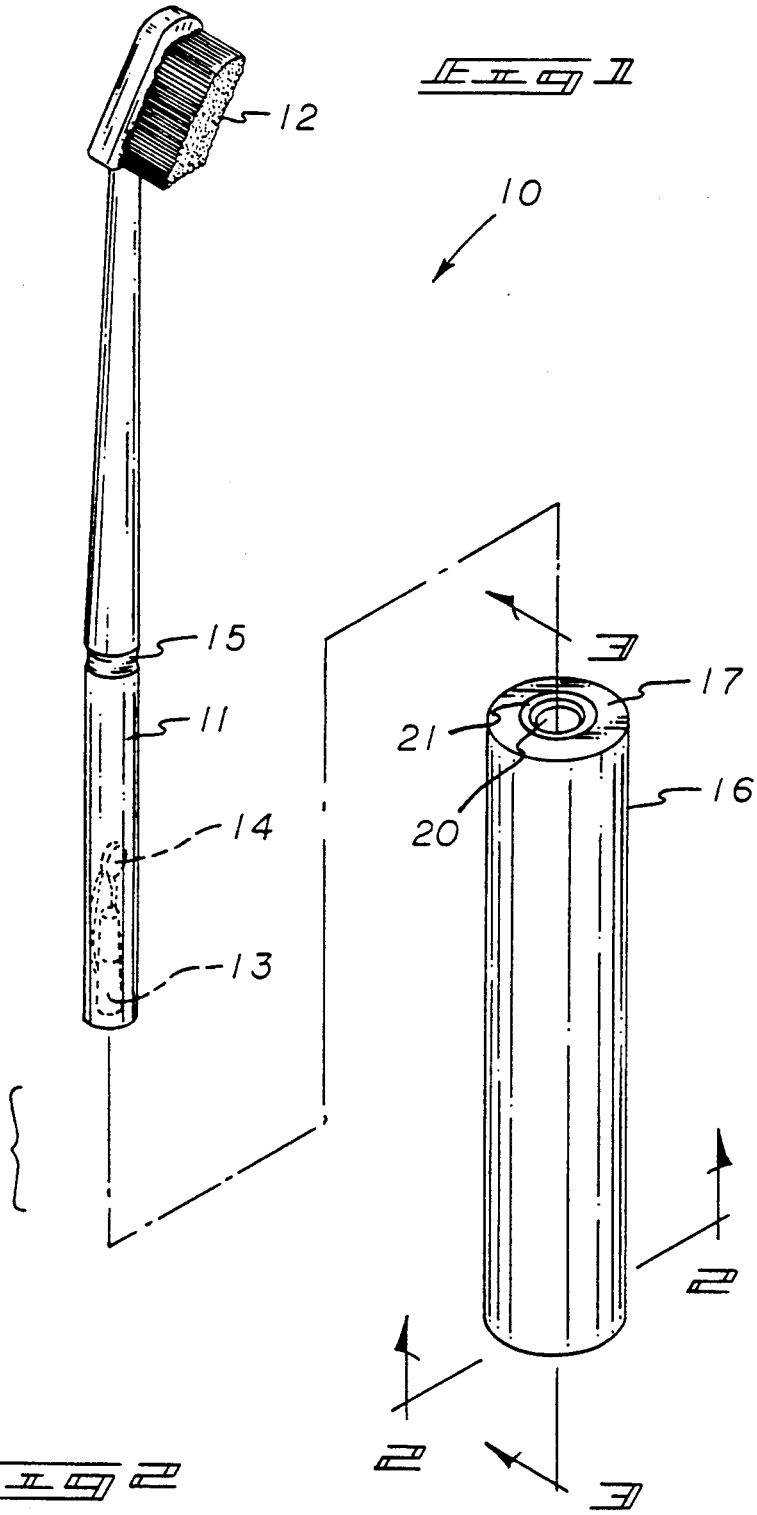
FIG. 1 is an isometric exploded view of the invention.
Figure 2:
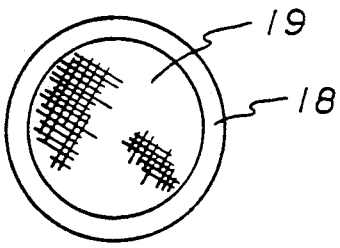
FIG. 2 is an orthographic view, taken along the lines 2—2 of FIG. 1 in the direction indicated by the arrows.
Figure 3:
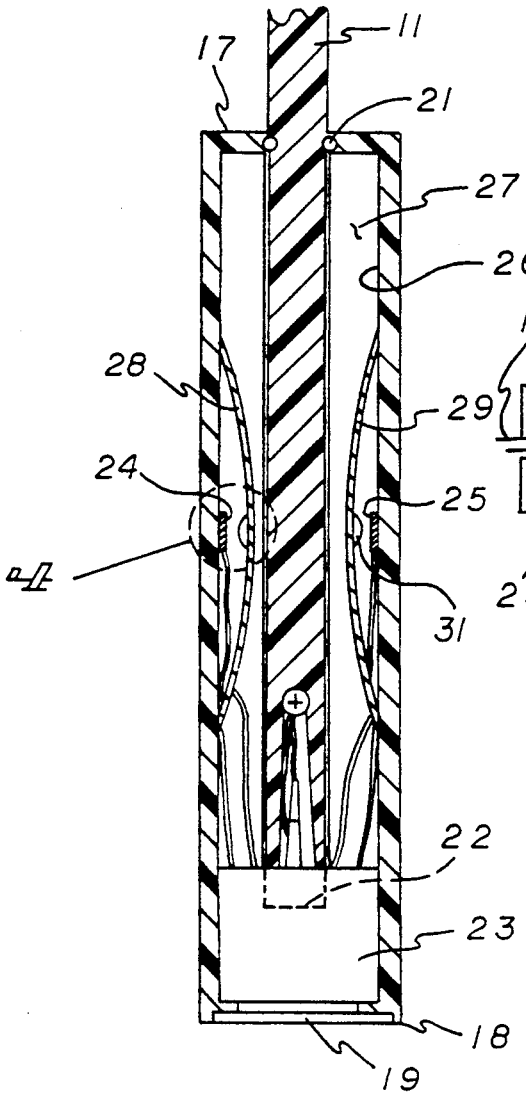
FIG. 3 is an orthographic view, taken along the lines 3—3 of FIG. 1 in the direction indicated by the arrows.
Figure 3A:
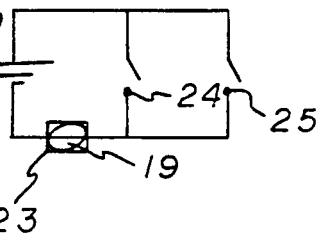
FIG. 3*a* is an exemplary electrical diagrammatic illustration of the switch structure in association with the audible speaker alarm.
Figure 4:
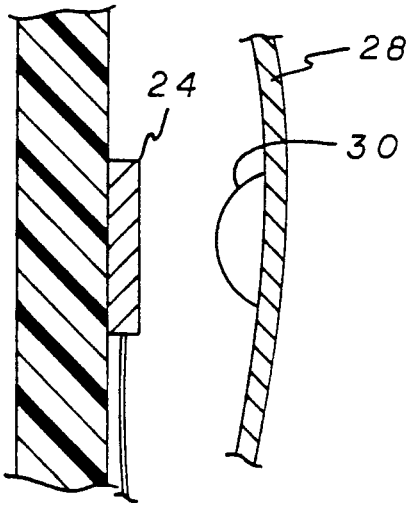
FIG. 4 is an enlarged orthographic view of section 4 as set forth in FIG. 3.

With reference now to the drawings, an in particular to FIGS. 1 to 9 thereof, a new and improved pressure alarm toothbrush assembly embodying the principles and concepts of the present invention and generally designated by the reference numeral 10 will be described.

More specifically, the pressure alarm toothbrush assembly 10 of the instant invention essentially comprises a toothbrush shaft 11, having a toothbrush head 12 mounted at a first end of the shaft, with a second end of the shaft having a shaft cavity 13 directed into the shaft 11 from the second end. Within the shaft cavity is a reachargeable battery structure 14 permitting selective recharging relative to such equipment that is known in the art and whose detail will not be addressed. If necessary, the battery 14 may be of a replacement type as required. An annular groove 15 is directed into the shaft 11 intermediate the first and second ends of the shaft, with the shaft arranged for reception within a support housing 16, having a housing top wall 17 spaced from a housing bottom wall 18. An audio speaker 19 is directed through the housing bottom wall 18, with a central opening 20 directed through the housing top wall 17. An "O" ring 21 is directed in surrounding relationship relative to the central opening 20 for frictional engagement with the toothbrush shaft 11, and more specifically the "O" ring 21 received within the annular groove 15 for proper registration and alignment of the shaft within the housing 16, with the second end of the shaft received within a housing socket 22 adjacent the housing bottom wall 18. An amplifier structure 23 is employed in association with the speaker 19 between the socket 22 and the speaker 19 for application of an audio alarm into the speaker 19.

First and second switch plates 24 and 25 are fixedly mounted to the housing interior wall surface 26 within the housing cavity 27. First and second spring plates 28 and 29 of arcuate configuration extend over the respective first and second switch plates 24 and 25, with the first and second spring plates 28 and 29 having respective first and second electrical contacts 30 and 31 positioned in a spaced adjacency relative to respective first and second switch plates 24 and 25, whereupon deflection of the toothbrush shaft 11 when secured within the housing 16 effects displacement of one of the contacts 30 or 31 into engagement with one of the respective first and second switch plates 24 and 25 to effect completion of an electrical circuit and actuation of an audio alarm through the amplifier 23 and the speaker 19.

Figure 5:
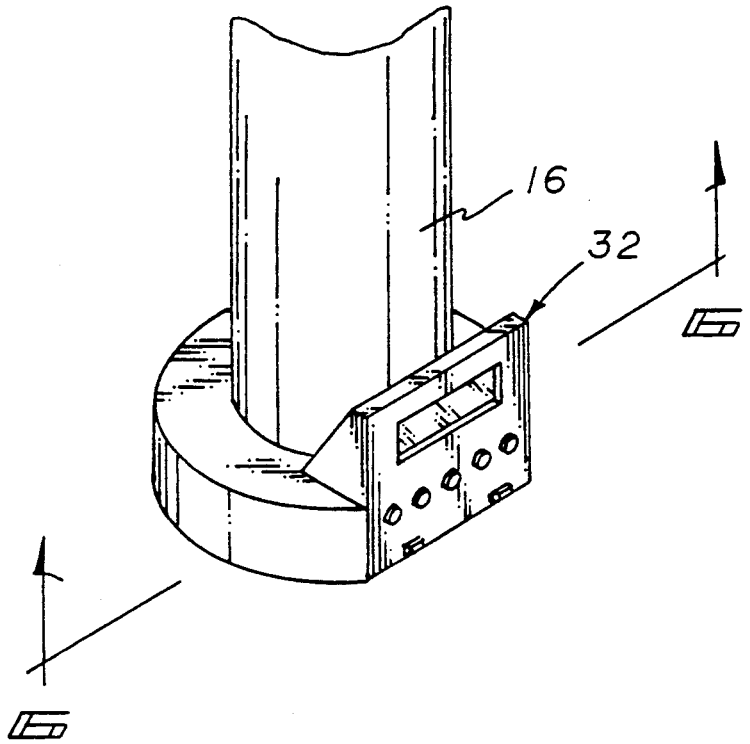
FIG. 5 is an isometric illustration of a toothbrush replacement alarm employed by the invention.
Figure 6:
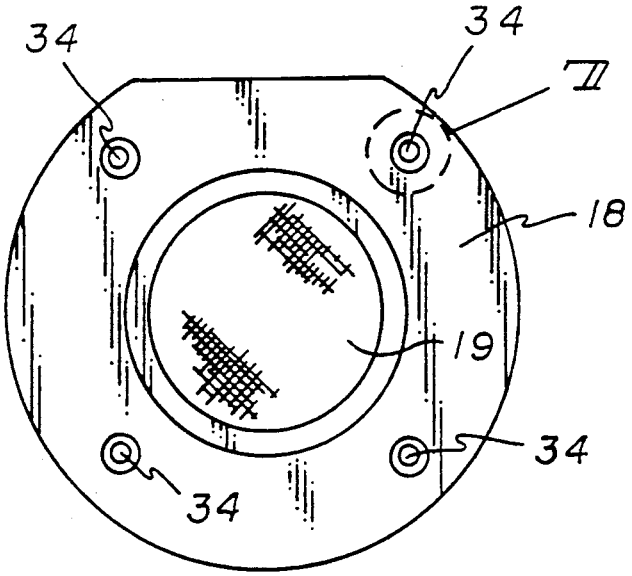
FIG. 6 is an orthographic view, taken along the lines 6—6 of FIG. 5 in the direction indicated by the arrows.

The FIG. 5 indicates the use of an optional timer member mounted in adjacency to an extended portion of the housing bottom wall 18, wherein the timer member is arranged in cooperative relationship with the speaker 19 to effect actuation to provide for indication of replacement of the toothbrush shaft 11 and the associated toothbrush head 12. This is for purposes of maintaining hygienic usefulness out of the toothbrush organization, wherein to prevent muffling of the thusly indicated alarm when the toothbrush housing 16 and the associated shaft 11 are in a vertically aligned orientation with the housing bottom wall 18 mounted upon a support surface, adjustable feet 34 are provided, with each foot 34 mounted to a threaded rod 35 threadedly received within the bottom wall 18 to provide for selective projection of each foot relative to the bottom wall permitting audible projection of the alarm effected by the timer member.

The FIGS. 8 and 9 indicates the use of adjusting means to adjust spacing of the contacts 30 and 31 relative to their associated first and second switch plates 24 and 25. To this end, the arcuate spring plates 28 are at a spring plate first end secured to the housing interior wall surface 26, and at a second end of each mounted to a housing intermediate web 41 mounted to the first housing 42 relative to the second housing 43. The first housing 42 is removable relative to the second housing 43, wherein a plurality of latch members 39 pivotally mounted to the second housing 43 are arranged for engagement about an annular housing flange 38 projecting beyond the exterior surface of the first housing 42 as indicated. In the separation, an externally threaded collar 36 fixedly mounted to the second housing to the second housing 43 about the housing socket 22 structures the externally threaded collar 36 to threadedly receive an internally threaded sleeve 37, with the sleeve 37 having a sleeve head 40 receiving the toothbrush shaft 11 therethrough in simultaneous engagement with the arcuate first and second spring plates 28 and 29. Upon threaded rotation of the first housing 42 onto the second housing 43 rotating the sleeve 37 to the collar 36 adjusts projection of the sleeve 37 along the spring plates 28 and 29 to engage and deflect the spring plates and the associated contacts 30 and 31 towards the respective first and second switch plates 24 and 25. Initial adjustment of the sleeve 37 may be afforded by directing the sleeve 37 along the spring plates and subsequently rotating the sleeve onto the collar 36 to maintain the projection of the sleeve 37 along the spring plates for deflection of the spring plates as noted above.

As to the manner of usage and operation of the instant invention, the same should be apparent from the above disclosure. and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be restored to, falling within the scope of the invention.

What is claimed as being new and desired to be protected by Letters Patent of the United States is as follows:

1. A pressure alarm toothbrush assembly, comprising, a toothbrush shaft, having a first end and a second end, with the first end having a toothbrush head fixedly mounted to the first end, and a shaft cavity directed into the toothbrush shaft through the second end, with a battery member contained within the shaft cavity, and an annular groove directed into the toothbrush shaft between the first end and the second end, and a support housing, the support housing having a top wall and a bottom wall, with an audio speaker directed into the support housing through the bottom wall, and a central opening directed into the support housing through the top wall in communication with a housing cavity within the support housing between the top wall and the bottom wall, and a housing sprocket coaxially aligned within the support housing relative to the support housing and the central opening, and an amplifier including connection means for effecting electrical communication between the battery member, the amplifier and the speaker, and a first switch plate and a second switch plate mounted fixedly within the housing and within the housing cavity, and a first arcuate spring plate and a second arcuate spring plate directed over the respective first switch plate and the second switch plate, the toothbrush shaft is positioned within the housing cavity and received through the central opening, and the toothbrush second end is received and positioned within the housing socket, the first switch plate and the second switch plate are respectively disposed adjacent the first switch plate and the second switch plate with flexure of the toothbrush shaft directing at least one of the first spring plate and the second spring plate towards the respective first switch plate and the second switch plate for contact of at least one of said first spring plate and the second spring plate with said respective first switch plate and second switch plate such that an electrical completion is made between said connection means, battery, amplifier, and speaker.

2. A toothbrush assembly as set forth in claim 1 further comprising the central opening including an "O" ring, with the "O" ring positioned within the annular groove to secure the toothbrush shaft in the housing.

3. A toothbrush assembly as set forth in claim 2 further comprising a timer mechanism mounted to the housing in electrical communication wit the speaker, and a plurality of adjustable feet mounted to the housing bottom wall to space the speaker relative to an underlying support, wherein each of the feet includes a threaded rod, and each threaded rod is threadedly directed adjustably into the housing bottom wall.

4. A toothbrush assembly as set forth in claim 3 further comprising the support housing including a first housing and a second housing, and a housing flange mounted to the first housing adjacent the second housing, and a plurality of latch members mounted to the second housing for securement to the housing flange, with an externally threaded collar fixedly mounted to the second housing, and an internally threaded sleeve rotatably mounted about the housing collar to adjust the sleeve relative to the collar, wherein the sleeve is arranged for engagement with the first spring plate and the second spring plate, whereupon axial projection of the sleeve relative to the collar adjusts flexure of the first spring plate towards the second spring plate.

* * * * *